US005392537A

United States Patent [19]

Goldberg

[11] Patent Number: 5,392,537

[45] Date of Patent: Feb. 28, 1995

[54] FOOTWEAR WITH TURNTABLE

[76] Inventor: Jack Goldberg, 15 Maple Grove, Toorak, Victoria 3142, Australia

[21] Appl. No.: 75,502

[22] PCT Filed: Dec. 20, 1991

[86] PCT No.: PCT/AU91/00590

§ 371 Date: Jun. 10, 1993

§ 102(e) Date: Jun. 10, 1993

[87] PCT Pub. No.: WO92/10954

PCT Pub. Date: Jul. 9, 1992

[30] Foreign Application Priority Data

Dec. 20, 1990 [AU] Australia ..... PK3977

[51] Int. Cl.[6] ..... A43B 5/00; A43C 15/00

[52] U.S. Cl. ..... 36/134; 36/115; 36/61

[58] Field of Search ..... 36/114, 115, 116, 126, 36/128, 61, 62, 132, 134, 136, 59 R

[56] References Cited

U.S. PATENT DOCUMENTS

| | | | |
|---|---|---|---|
| 3,204,3348 | 9/1965 | Latson | 36/136 X |
| 2,640,283 | 6/1953 | McCord | 36/31 X |
| 3,091,043 | 5/1963 | McCorkie | 36/115 X |
| 3,707,047 | 12/1972 | Nedwick | 36/2.5 |
| 3,824,710 | 7/1974 | Egtvedt | 36/2.5 |
| 4,271,610 | 6/1981 | Parrent | 36/136 |
| 4,541,185 | 9/1985 | Chou | 36/114 |

FOREIGN PATENT DOCUMENTS

| | | | |
|---|---|---|---|
| 53705/86 | 8/1986 | Australia . | |
| 34068/89 | 11/1989 | Australia . | |
| 1474358 | 3/1967 | France . | |
| 2565469 | 12/1985 | France . | |
| 229175 | 12/1910 | Germany | 36/61 |
| 1957191 | 6/1970 | Germany | 36/61 |
| 3622844 | 1/1988 | Germany . | |
| 1131803 | 10/1968 | United Kingdom . | |
| 1299448 | 12/1972 | United Kingdom . | |

*Primary Examiner*—Paul T. Sewell
*Assistant Examiner*—Beth Anne Cicconi
*Attorney, Agent, or Firm*—Nixon & Vanderhye

[57] ABSTRACT

An article of footwear (10) has a sole (12) with a lower surface (14) and a recess (16) in the lower surface (14). A turntable (20) is mounted in the recess (16) for rotational movement relative to the sole (12) but joined thereto by projections (40) located in recesses (30) in the sole (12).

17 Claims, 5 Drawing Sheets

FOOTWEAR WITH TURNTABLE

BACKGROUND

I. Field of the Invention

This invention relates to footwear and refers particularly, though not exclusively, to footwear having a portion of the sole on the outer surface thereof provided with a relatively rotatable member.

II. Related Art and Other Considerations

The ever-increasing incidence of major injuries to people active in sports is of great concern to orthopaedic surgeons. Many of the most traumatic injuries occur during the act of twisting or turning. If the foot is for some reason held rigid, dramatic injuries can occur to the knee, groin, ankle or skeletal parts. In some instances, the injuries are so traumatic that extensive surgery is required, long recuperative periods necessary, and the ability of the person to play the sport again is either eliminated, significantly reduced or delayed considerably.

Part of the problem relates to modern footwear design where the use of special materials and tread patterns on the soles of shoes, particularly in relation to sports such as basketball, netball, football and soccer, means that when the foot is firmly upon the surface, it is very difficult to twist. This has contributed to rather major knee injuries.

It is therefore the principal object of the present invention to provide footwear where on the outer surface of the sole there is provided a relatively rotatable member.

SUMMARY

With the above and other objects in mind the present invention provides an article of footwear having a sole, said sole having a lower surface, there being a recess in said lower surface, and a turntable mounted in said recess rotatable relative to said sole.

BRIEF DESCRIPTION OF THE DRAWINGS

In order that the present invention may be readily understood there shall now be described preferred constructions of articles of footwear incorporating the principal features of the present invention, the description being by way of non-limitative example only and being with reference to the accompanying illustrative drawings. In the drawings.

DETAILED DESCRIPTION OF THE DRAWINGS

Figure 1:
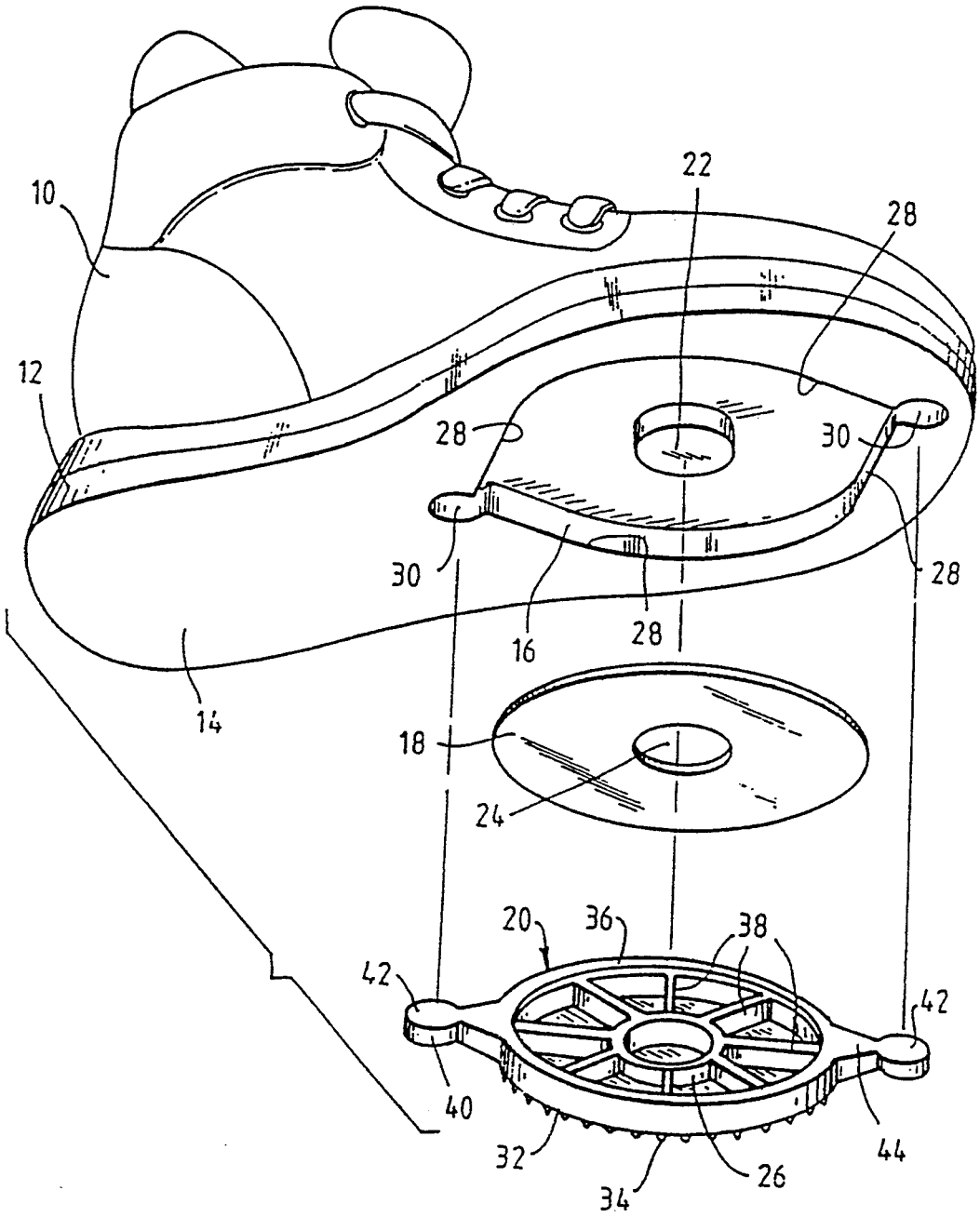
FIG. 1 is an exploded perspective view of a first embodiment of the present invention when viewed from below.

To first refer to the embodiment shown in FIGS. 1 through to 5, there is shown an article of footwear 10 having a sole 12 with a lower surface 14. The lower surface 14 has a recess generally designated as 16 into which is intended to be located a disc 18 and a turntable 20.

To particularly refer to FIG. 1, the recess generally designated as 16 is substantially circular and of a height slightly less than the height of the turntable 20. It has a central lug 22 on the undersurface thereof which serves to locate both the disc 18 by virtue of the central aperture 24 and the turntable 20 by virtue of a cylindrical projection 26. The recess 16 is approximately circular although there are four flats generally designated as 28, the purpose of which will be understood from the following description. The flats 28 are arranged in pairs on either side of an approximately circular recess 30, there being two such recesses 30. The recesses 30 are diametrically opposed and are normally, or preferably, arranged with one at the toe and one towards the heel.

The purpose of the disc 18 is to assist in the rotation of the turntable 20 relative to the sole 12. The turntable 20 comprises a flat lower surface 32 having a tread pattern 34 embossed thereon. It has side walls 36 which are of a height approximately the same as the height of the recess 16. As is explained above, there is a cylindrical aperture or recess 26 on the upper surface of the turntable 20. From this there are a number of radial arms 38 extending to the side wall 36. The purpose of these arms 38 is to provide strength and stability. There are two diametrically opposed projections 40 which have at the outer ends thereof lugs 42 which are adapted to engage in the recesses 30. In this way, the turntable 20 can be located accurately in the recess 16. Linking the lugs 42 to the side walls 36 are link arms 44 which are substantially triangular in shape.

Figure 2:
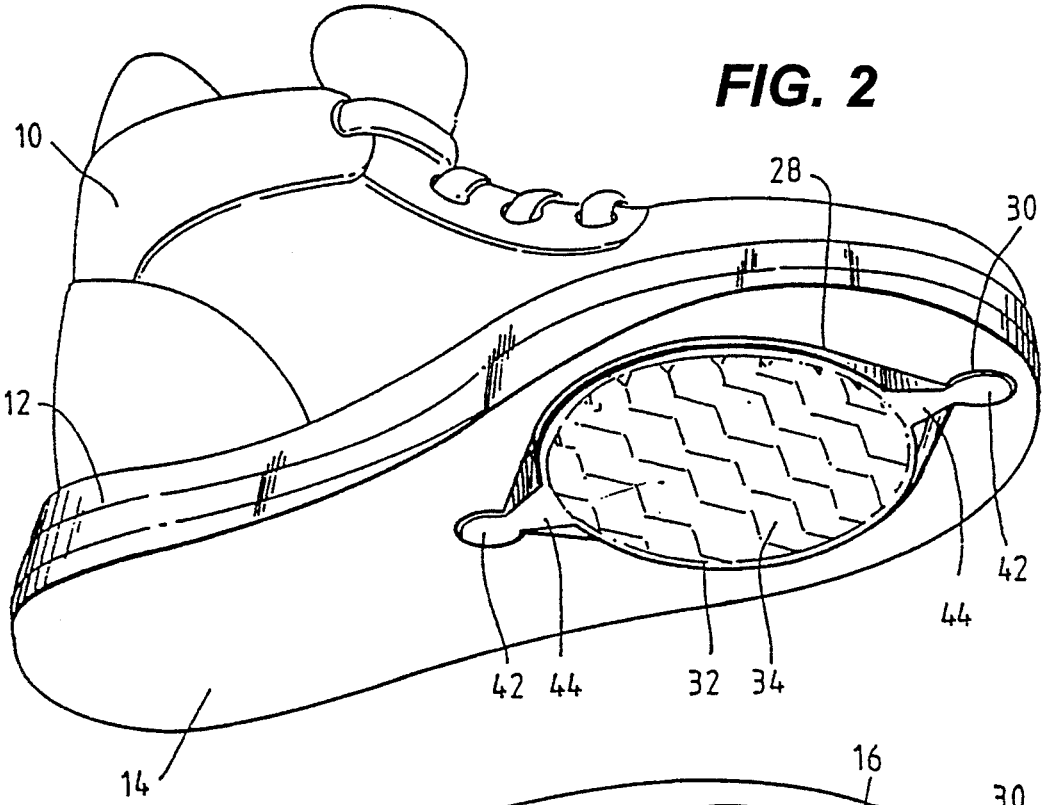
FIG. 2 is a view corresponding to FIG. 1 but in the assembled position.
Figure 3:
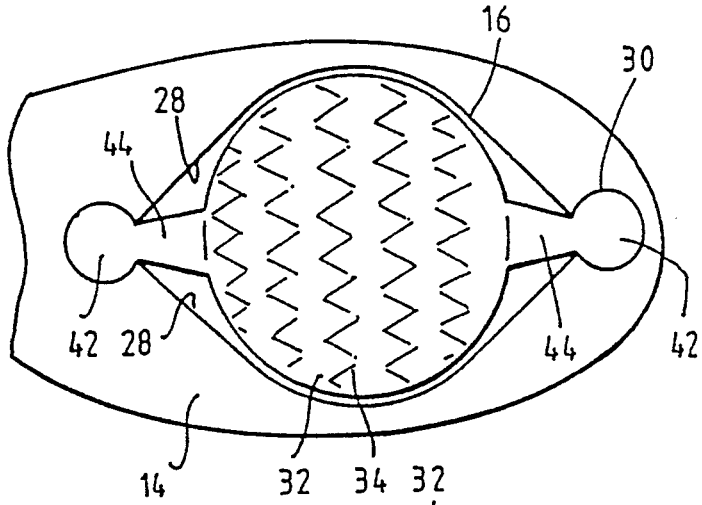
FIG. 3 is an underneath view of the ball portion of the embodiment of FIG. 2.
Figure 5:
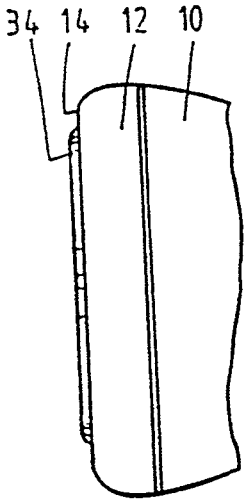
FIG. 5 is a view corresponding to FIG. 3 but being an end elevation view.
Figure 4:
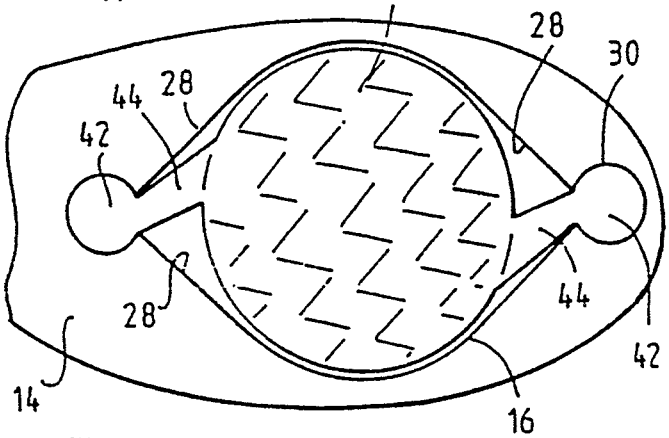
FIG. 4 is a view corresponding to FIG. 3 but in the relatively rotated position.

When assembled, the turntable 20 is located in the recess 16. The lugs 42 engage in recesses 30. This is dear from FIG. 2. As is clear from FIG. 5, the embossed surface 34 projects below surface 14 of sole 12. When in the rest position of FIG. 3, the arms 44 extend approximately radially. However, upon a twist force being applied, the turntable 20 rotates relative to the sole 12. The central protection 22 provides the pivoting axis. However, the arms 44 provide a limit of rotational movement. As can be seen in FIG. 4, a side of each of the arms 44 will contact the flat surface 28 to thus prevent any further movement. In fact, these arms 44 are made of an elastomeric material (of any known, suitable type) to provide progressive damping to the rotation so as to reduce the likelihood of injury to the knee. If there is any further rotational force, there may be a tendency to remove the lugs 42 from the recesses 30 and thus provide, in effect, a form of temporary or repairable destruction of the sole. This would prevent permanent and very difficult repair of the knee of the wearer. Naturally, in the event of going beyond the angle indicated in FIG. 4 (approximately 30° of rotation) the item of footwear would have to be removed and the turntable 20 placed back into position correctly. If the angle of rotation was of that shown in FIG. 4 or less, upon the rotational force being removed, the turntable would resume the position shown in FIG. 3.

Figure 6:
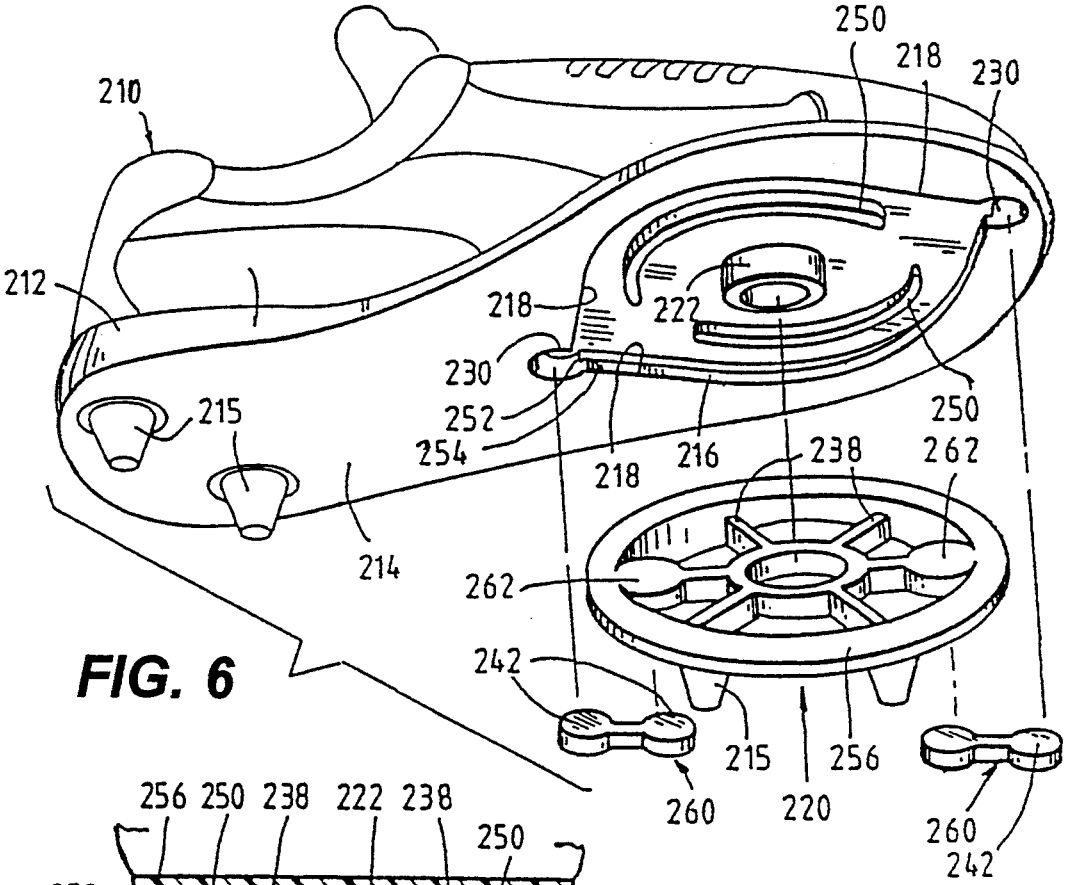
FIG. 6 is a view corresponding to FIG. 1 but of a second embodiment.
Figure 7:
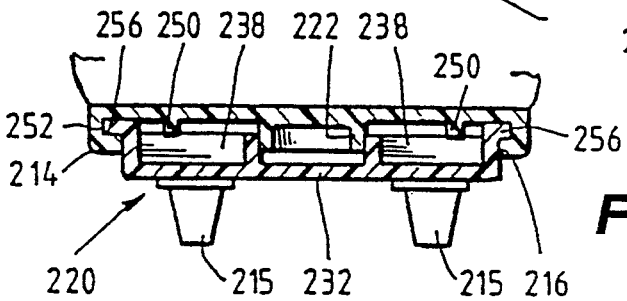
FIG. 7 is a view corresponding to FIG. 6 but with all components assembled.
Figure 8:
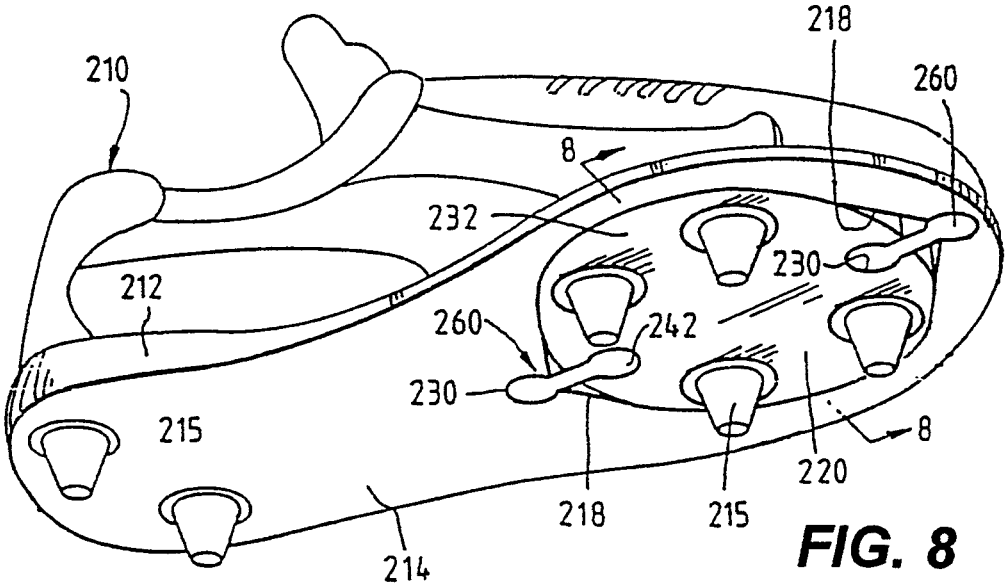
FIG. 8 is a cross sectional view (partial) along the lines and in the direction of arrows 8—8 of FIG. 7.

A variation of this is shown in FIGS. 6 to 8, The particular article of footwear 210 in this instance is dearly one which is intended to be used on a sporting field and therefore represents an item such as a soccer, football or rugby boot, As is customary, like parts will be described using similar reference numerals as for the embodiment of FIGS. 1 through to 5, but with the addition of the prefix number 2 indicating the second embodiment. Again in this instance the boot 210 has a sole 212 with a lower surface 214. In this particular instance there are a number of stops or sprigs 215 in the sole, The sole again has a recess generally designated as 216. In this particular instances no intermediate disc is required but there is a turntable 220. In this particular instance the recess 216 is somewhat similar to the recess 16 of FIGS. 1 to 5. It again has the central projection 222 but in addition has two arcuate ribs 250 extending in a circumferential manner around the central projection 222 but inside the recess 216. These stop short of the recesses 230, as will be understood from the following description. In addition, there is an undercut 252, Furthermore, although there are flats 218 in a similar manner to that of the embodiment of FIGS. 1 to 5, there are projections 254 on the flats which first of all assist in sealing of the turntable against unwanted ingress of mud, etc., and secondly provide for a continuous circular path for the side walls of the recess 216, Again, the undercut 252 extends under the projections 254.

The turntable 220 is very much the same as the turntable 20 described in the embodiment of FIGS. 1 to 5. However, it has a peripheral rib 256 which is adapted to be a relatively tight fit in the undercut 252. In addition, the radial arms 238 are of a lesser height so that the ribs 250 will be able to be located under the turntable 220. This is dearly illustrated in FIG. 8. The principal surface 232 of the turntable 20 does not have any embossed surface but again a number of stops or sprigs 215 are provided to work in the usual manner.

The purpose of the ribs 250, undercut 252 and peripheral rib 256 is to provide, in effect, a form of sealing. Sporting grounds such as used for football, rugby and soccer have a great tendency to become muddy in the event of rain or other adverse weather conditions. By using this construction, the tendency for mud or other contaminants to get inside the recess 216 is at least reduced. The projections 254 allow the "sealing" effect to be continued for the maximum possible peripheral distance.

In this particular instance there are provided projections 260 which are adapted to be received in recesses 262 in the turntable 220 and in the recesses 230 in the sole 214. Again, lugs 242 are provided although in this instance there are lugs 242 at each end. However, the operation is still the same and thus upon there being rotation of the turntable 220, contact will be made with the straights 218 to prevent any further, unwanted movement. As a variation, it is possible to have the link members 260 made integral with the turntable 220.

Figure 9:
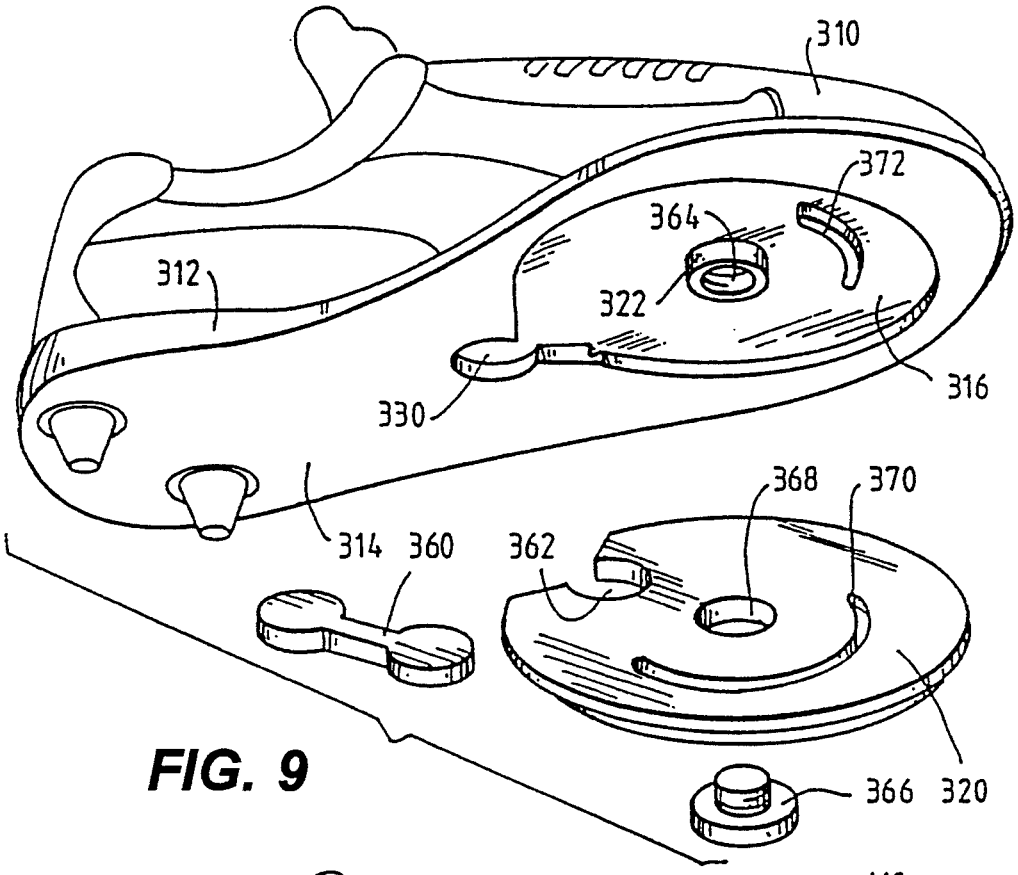
FIG. 9 is a perspective view corresponding to that of FIG. 1 but of a third embodiment.
Figure 10:
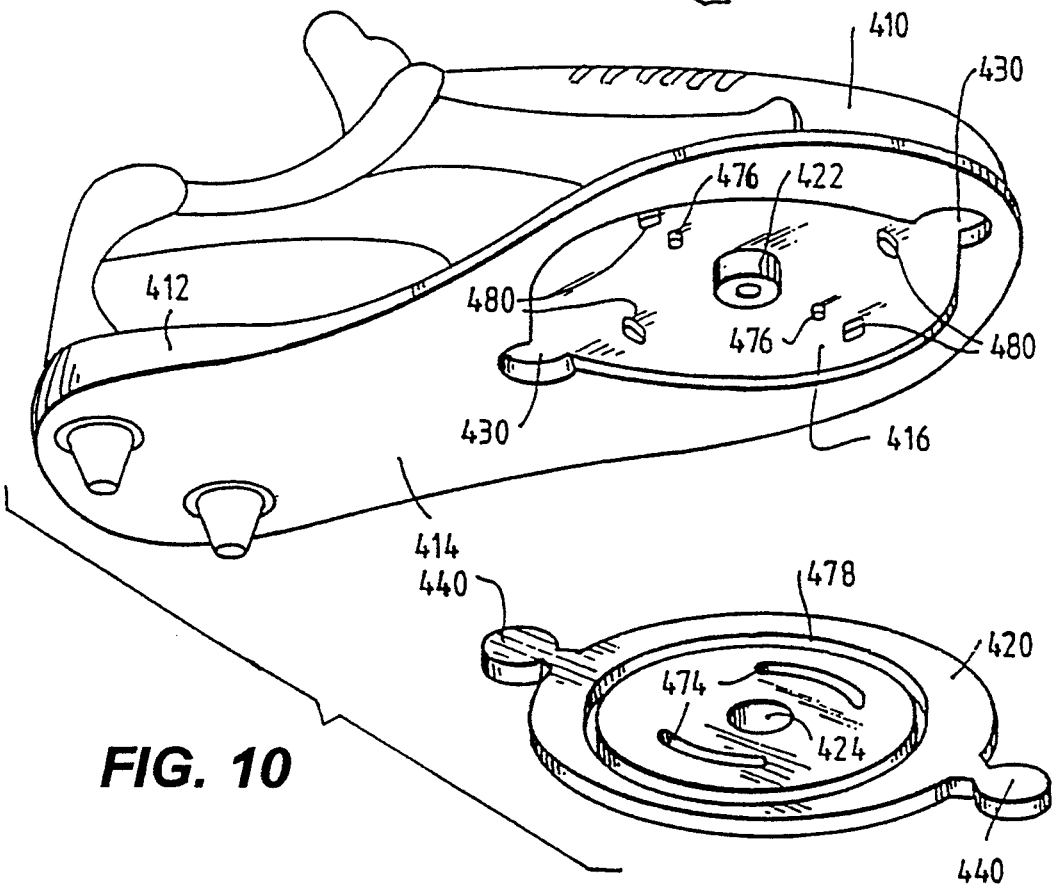
FIG. 10 is a view corresponding to that of FIG. 1, but of a fourth embodiment.

A further variation is shown in the embodiment of FIG. 9 and in this particular instance there is provided an item of footwear 310 having a sole 312 with a lower surface 314. A turntable 320 is provided located in a recess 316 in the sole 312. However, in this particular instance there is a single link member 360 separate from both the sole 312 as well as the turntable 320. The link member 360 is "dumbbell" shaped to fit into a recess 362 in turntable 320 and recess 330 in sole 314. Once again the use of a suitable elastomeric material will provide the required progressive damping effect. Furthermore, in the instance of excessive rotational movement, there may be a tendency for the link member 360 to be removed from either or both of the recesses 362 or 330; or for the member 360 to fracture. The member 360 could easily be re-inserted into the recesses 362 or 330; or replaced, if required.

In addition, the central projection 322 has a blind hold 364 therein to enable a fastener 366 to pass through a central aperture 368 in turntable 326 and to thus releasably secure the turntable 320 in recess 316. Both the hole 364 and fastener 366 may be threaded or, if desired, a "snap-fit" may be used.

Furthermore, the turntable 320 has an accurate slot 370 which cooperates with a curved lug 372 to limit the angular movement of the turntable 320 relative to the sole 314. This may also assist in limiting flexing of turntable 320.

Figure 11:
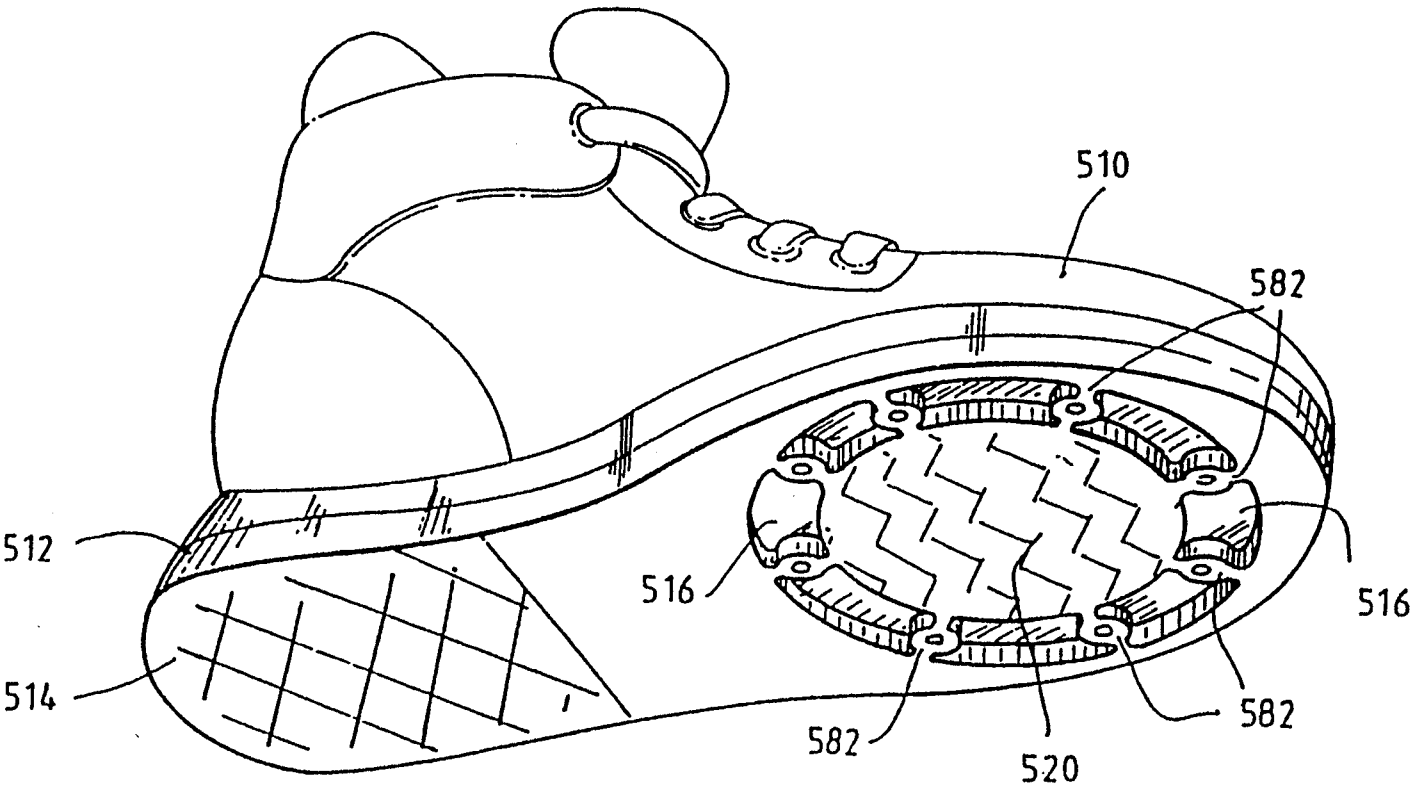
FIG. 11 is a view corresponding to that of FIG. 1 but of a fifth embodiment.

This concept is further developed in the embodiment of FIG. 11. Here, the shoe or boot 410 has a sole 412 with a lower surface 414. Again, a recess 416 is provided, with there being a central projection 422 which locates the turntable 420 in position via the central aperture 424. The turntable 420 is solid, as are the projections 440. The projections 440 engage in recesses 430. Two arcuate slots 474 are created in the turntable 420 but not extending therethrough. The slots 474 cooperate with lugs 476 to limit the angular movement of turntable 420 relative to sole 412. In addition, there is a circular outer groove 478 between the slots 474 and the periphery of turntable 420 and which cooperates with projections 480 in recess 416 to provide additional stability for turntable 420. The groove 478 may be undercut, and projections 480 headed, to assist this function. This would make the shoe 410 ideal for aerobics, running, basketball, football or the like, where twisting on hard surfaces was common.

The embodiment of FIG. 9 has a shoe 510 with a sole 512 with a lower surface 514. A turntable 520 is provided located in a recess 516 in sole 512. However, there are link members 582 which are integral with both the sole 512 as well as the turntable 520. There are a number of link members 582 around the periphery of turntable 520. Once again, the use of a suitable elastomeric material will provide the required progressive damping effect. In the instance of excessive rotation, link members 582 may be destroyed, thus making shoe 510 unusable.

Naturally, the various embodiments illustrated have various modifications. It may be possible to combine these in various ways for a particular item of footwear, if desired.

Whilst there has been described in the foregoing description preferred constructions of items of footwear incorporating the principal features of the present invention, it will be understood by those skilled in the art that many variations or modifications in details of design or construction may be made that departing from the essential features of the present invention.

I claim:

1. An article of footwear having a sole, (i) said sole having a lower surface;

(ii) a recess in said lower surface; and (iii) a turntable located in said recess and being mounted onto said sole for rotational movement relative to said sole about a longitudinal axis of said turntable;

(iv) said turntable being connected to said sole by at least one projection of elastomeric material attached to said turntable and to said sole;

(v) said at least one projection being so dimensioned and of sufficient resiliency to limit the degree of angular rotation of said turntable relative to said sole, and to cause said turntable to return to a rest position when no external force is applied to said turntable.

2. An article of footwear as claimed in claim 1, wherein said at least one projection is located in a further recess in said sole.

3. An article of footwear as claimed in claim 2, wherein said at least one projection is integral with said turntable.

4. An article of footwear as claimed in claim 2, wherein said at least one projection is separate from both said turntable and said sole, said at least one projection being located to engage a corresponding further recess in said sole.

5. An article of footwear as claimed in claim 4, wherein said at least one projection is "dumbbell" shaped in that it has two bulbous ends joined by a relatively narrow middle.

6. An article of footwear as claimed in claim 4, wherein there are two diametrically opposed projections, each of the two projections being located to engage a corresponding further recess in said sole.

7. An article of footwear as claimed in claim 2, wherein said recess has a side wall, said further recess being in said side wall, said side wall being substantially straight either side of said further recess.

8. An article of footwear as claimed in claim 7, wherein said side wall has an undercut to receive a peripheral protection on said turntable.

9. An article of footwear as claimed claim 1, wherein said sole has a central lug projecting downwardly into said recess, said central lug being adapted to locate in an aperture in said turntable.

10. An article of footwear as claimed in claim 9, wherein said central lug has a blind hole therein, there being a fastener passing through said aperture and into said blind hole to attach said turntable into said recess.

11. An article of footwear as claimed in claim 10, wherein said blind hole and said fastener are screw-threaded.

12. An article of footwear as claimed in claim 10, wherein said fastener is received in said blind hole in the manner of a snap fit.

13. An article of footwear as claimed claim 2, wherein there is one said projection, said turntable having an arcuate slot therein cooperating with a curved lug projecting downwardly in said recess to limit the angular rotation of said turntable.

14. An article of footwear as claimed in claim 2, wherein said turntable has two diametrically opposed slots therein, each slot cooperating with a lug projecting downwardly in said recess to limit the angular rotation of said turntable.

15. An article of footwear as claimed in claim 1, wherein said turntable has a circular slot therein cooperating with at least one retaining lug projecting downwardly in said recess to assist in retaining said turntable in said recess.

16. An article of footwear as claimed claim 2, wherein there are a plurality of said projections around the periphery, of said turntable, said projections being integral with said turntable and said sole.

17. An article of footwear as claimed in claim 1, wherein there is an intermediate disc above said turntable in said recess.

* * * * *